US011782469B1

(12) United States Patent
Chiang et al.

(10) Patent No.: US 11,782,469 B1
(45) Date of Patent: Oct. 10, 2023

(54) REFERENCE SIGNAL GENERATOR HAVING HIGH ORDER TEMPERATURE COMPENSATION

(71) Applicant: Richtek Technology Corporation, Zhubei (TW)

(72) Inventors: Chia-Tseng Chiang, New Taipei (TW); Yi-Hsiang Juan, Taipei (TW)

(73) Assignee: RICHTEK TECHNOLOGY CORPORATION, Zhubei (TW)

( * ) Notice: Subject to any disclaimer, the term of this patent is extended or adjusted under 35 U.S.C. 154(b) by 0 days.

(21) Appl. No.: 18/045,478

(22) Filed: Oct. 11, 2022

(30) Foreign Application Priority Data

Apr. 11, 2022 (TW) ..... 111113712

(51) Int. Cl.
*G05F 3/30* (2006.01)
*G05F 1/567* (2006.01)

(52) U.S. Cl.
CPC ..... *G05F 1/567* (2013.01); *G05F 3/30* (2013.01)

(58) Field of Classification Search
None
See application file for complete search history.

(56) References Cited

U.S. PATENT DOCUMENTS 4,808,908 A 2/1989 Lewis et al.
6,329,804 B1 * 12/2001 Mercer ..... G05F 3/30 323/314
7,248,098 B1 * 7/2007 Teo ..... G05F 3/30 327/539
7,420,359 B1 * 9/2008 Anderson ..... G05F 3/30 327/535
8,415,940 B2 4/2013 Yin et al.
8,736,387 B2 * 5/2014 Mahooti ..... G05F 3/30 331/185
8,866,539 B2 * 10/2014 Sano ..... G05F 3/267 327/539
9,367,077 B2 * 6/2016 Kiuchi ..... G05F 3/30
9,442,508 B2 * 9/2016 Kochkin ..... G05F 3/16
9,582,021 B1 * 2/2017 Arnold ..... G05F 3/16
9,898,029 B2 * 2/2018 Rasmus ..... G05F 3/242
10,290,330 B1 * 5/2019 Kamath ..... G11C 7/04
10,635,127 B2 * 4/2020 Hirose ..... G05F 3/30
10,684,637 B2 * 6/2020 Yoshida ..... G05F 1/463
11,526,191 B2 * 12/2022 Sreenivasan ..... G05F 3/30

* cited by examiner

*Primary Examiner* — Thomas J. Hiltunen
(74) *Attorney, Agent, or Firm* — Tung & Associates

(57) ABSTRACT

A reference signal generator having high order temperature compensation includes: first and second transistors generating a proportional to absolute temperature (PTAT) signal and at least one complementary to absolute temperature (CTAT) signal according to at least one bandgap related to the first and second transistors; a feedback network coupled to the first and second transistors; an amplifier circuit configured to linearly superimpose the PTAT signal and the CTAT signals via the feedback network, to generate a reference signal; a second order adjustment circuit including a third transistor controlled by a bias voltage, to generate an adjustment current for adjusting the reference signal; and a third order adjustment circuit configured to adjust the bias voltage according to a temperature under test, for adjusting the adjustment current, to adjust the reference signal, such that a variation of the reference signal is smaller than a predetermined variation range within a temperature range.

8 Claims, 8 Drawing Sheets

REFERENCE SIGNAL GENERATOR HAVING HIGH ORDER TEMPERATURE COMPENSATION

CROSS REFERENCE

The present invention claims priority to TW 111113712 filed on Apr. 11, 2022.

BACKGROUND OF THE INVENTION

Field of Invention

The present invention relates to a reference signal generator; particularly, it relates to such reference signal generator having high order temperature compensation.

Description of Related Art

The following prior arts are relevant to the present invention: U.S. Pat. No. 4,808,908 "Curvature correction of bipolar bandgap voltage reference" and U.S. Pat. No. 8,415,940 "Temperature compensation circuit and method for generating a voltage reference with a well-defined temperature behavior".

FIG. 1A shows a schematic diagram of a conventional reference signal generator (i.e., reference signal generator 1000). FIG. 1B shows voltage-versus-temperature curves corresponding to signals of the conventional reference signal generator of FIG. 1A. The reference signal generator 1000 comprises: a transistor Q11, a transistor Q21, an amplifier 21 and a feedback network 101. The feedback network 101 includes: resistors R11, R21, and R31. The transistor Q11 and the transistor Q21 are coupled to each other, wherein the transistor Q11 and the transistor Q21 generate a complementary to absolute temperature (CTAT) signal Vbe1, a CTAT signal Vbe2, and a proportional to absolute temperature (PTAT) signal ΔVbe' according to bandgaps of the transistor Q11 and the transistor Q21, wherein the PTAT signal ΔVbe' is a difference between the CTAT signal Vbe1 and the CTAT signal Vbe2. Each of the CTAT signal Vbe1 and the CTAT signal Vbe2 is a complement of a bandgap voltage and k*Ta, wherein k denotes a positive real number and Ta denotes an absolute temperature. That is, the CTAT signal Vbe1 and the CTAT signal Vbe2 decrease linearly as the absolute temperature increases. The amplifier 21 linearly superimposes the CTAT signals Vbe1 and Vbe2 and the PTAT signal ΔVbe' via the feedback network, so as to generate a reference signal Vbg' which substantially does not change as the absolute temperature Ta changes (as shown in FIG. 1B). The reference signal Vbg' is correlated with the above-mentioned bandgaps, wherein a relationship between the reference signal Vbg' and the above-mentioned bandgaps can be represented by the following equation:

$$Vbg'=(\Delta Vbe'*R11)/R31+Vbe2$$

wherein ΔVbe'=Vbe1−Vbe2

Please refer to FIG. 1C, which shows a voltage-versus-temperature curve corresponding to a reference signal of the conventional reference signal generator of FIG. 1A. Although in an ideal condition, the reference signal Vbg' does not change as the absolute temperature Ta changes (as shown in FIG. 1B), nevertheless, in a realistic situation, the reference signal Vbg' behaves as a curve indicated in FIG. 1C (the curve indicated in FIG. 1C is the reference signal Vbg' shown in FIG. 1B in a broader aspect). As a result, the prior art reference signal generator 1000 still has the drawback that the reference signal Vbg' changes as the temperature changes, which undesirably causes the circuit system to suffer issue of imprecision.

As compared to the prior art, the present invention is advantageous in that: first, the present invention executes a second order compensation on the reference signal Vbg' to make the reference signal Vbg' more accurate. Second, in case necessary, the present invention can further execute a third order compensation on the reference signal Vbg' if the second order compensation over-compensate to cause inaccuracy. Third, during the third order compensation, the compensated temperature range can be flexibly selected, whereby the reference signal Vbg' can be more accurate and close to ideal, that is, the reference signal Vbg' of the present invention is almost not affected by any temperature change at all.

SUMMARY OF THE INVENTION

From one perspective, the present invention provides a reference signal generator, which is configured to operably generate a reference signal, wherein the reference signal includes: a reference voltage and/or a reference current; the reference signal generator comprising: a first transistor and a second transistor coupled to each other, wherein the first transistor and the second transistor are configured to operably generate a proportional to absolute temperature (PTAT) signal and at least one complementary to absolute temperature (CTAT) signal according to at least one bandgap related to the first transistor and the second transistor, wherein the CTAT signal substantially linearly decreases from a voltage level of the bandgap as an absolute temperature increases; a feedback network coupled to the first transistor and the second transistor; an amplifier circuit coupled to the first transistor and the second transistor, wherein the amplifier circuit is configured to operably and linearly superimpose the PTAT signal and the CTAT signal via the feedback network, so as to generate the reference signal; a second order adjustment circuit including a third transistor, wherein the third transistor is controlled by a bias voltage, so as to generate an adjustment current for adjusting the reference signal, wherein the adjustment current is positively correlated with a temperature under test; and a third order adjustment circuit, which is configured to operably adjust the bias voltage according to the temperature under test, thus adjusting the adjustment current, and to thereby adjust the reference signal, such that a variation of the reference signal is smaller than a predetermined variation range within a range of the temperature under test.

In one embodiment, the first transistor and the second transistor are bipolar junction transistors (BJTs) having a same conductivity type.

In one embodiment, the third transistor is a BJT, and wherein the third transistor has a same conductivity type as the first transistor and the second transistor.

In one embodiment, a base voltage of the third transistor is controlled by the bias voltage, wherein the adjustment current is generated according to a collector current of the third transistor.

In one embodiment, the third order adjustment circuit includes: a comparator and an adjustment switch, wherein the comparator is configured to operably compare a signal related to the temperature under test (temperature related signal) with a reference threshold, so as to generate a comparison result, wherein the temperature related signal is correlated with the temperature under test, wherein the adjustment switch is switched according to the comparison result, so as to adjust the bias voltage.

In one embodiment, a hysteresis relationship exists between the reference threshold and the temperature related signal.

In one embodiment, the temperature related signal is a CTAT signal.

In one embodiment, the amplifier circuit controls the first transistor to generate a first current and controls the second transistor to generate a second current; the feedback network generates a first order bandgap signal according to the first current and the second current; the feedback network includes: an adjustment resistor, which is configured to operably generate a temperature compensation voltage at the adjustment resistor according to the first current, the second current and the adjustment current; and the reference signal is obtained by superimposing the first order bandgap signal and the temperature compensation voltage.

In one embodiment, the second order adjustment circuit further includes: a voltage-divider circuit, which is configured to operably execute voltage-division on the first order bandgap signal to generate the bias voltage, for biasing the base voltage of the third transistor, wherein the third order adjustment circuit adjusts a voltage-division ratio of the voltage-divider circuit according to the temperature under test.

The objectives, technical details, features, and effects of the present invention will be better understood with regard to the detailed description of the embodiments below, with reference to the attached drawings.

DESCRIPTION OF THE PREFERRED EMBODIMENTS

The drawings as referred to throughout the description of the present invention are for illustration only, to show the interrelations between the circuits and the signal waveforms, but not drawn according to actual scale of circuit sizes and signal amplitudes and frequencies.

Figure 1A:
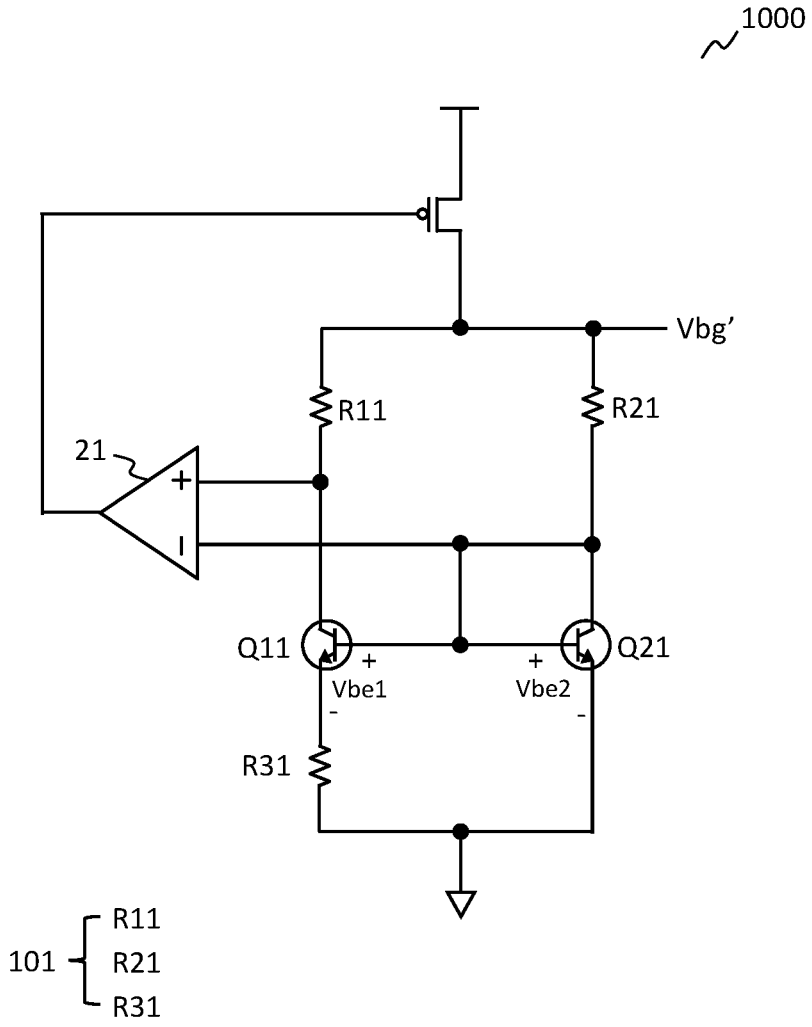
Fig. 1A (Prior Art)
FIG. 1A shows a schematic diagram of a conventional reference signal generator.
Figure 1B:
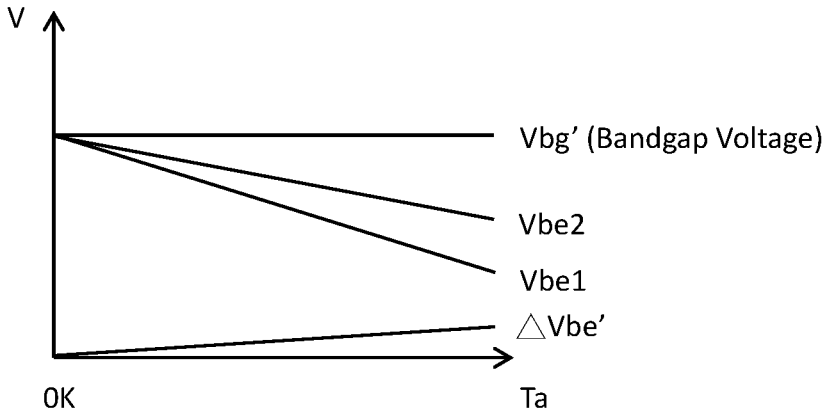
Fig. 1B (Prior Art)
FIG. 1B shows voltage-versus-temperature curves corresponding to signals of the conventional reference signal generator of FIG. 1A.
Figure 1C:
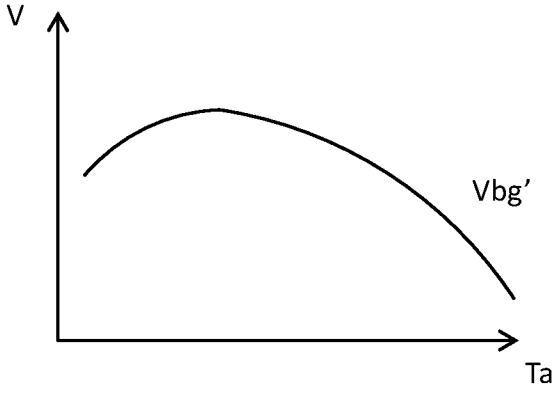
Fig. 1C (Prior Art)
FIG. 1C shows a voltage-versus-temperature curve corresponding to a reference signal of the conventional reference signal generator of FIG. 1A.
Figure 2A:
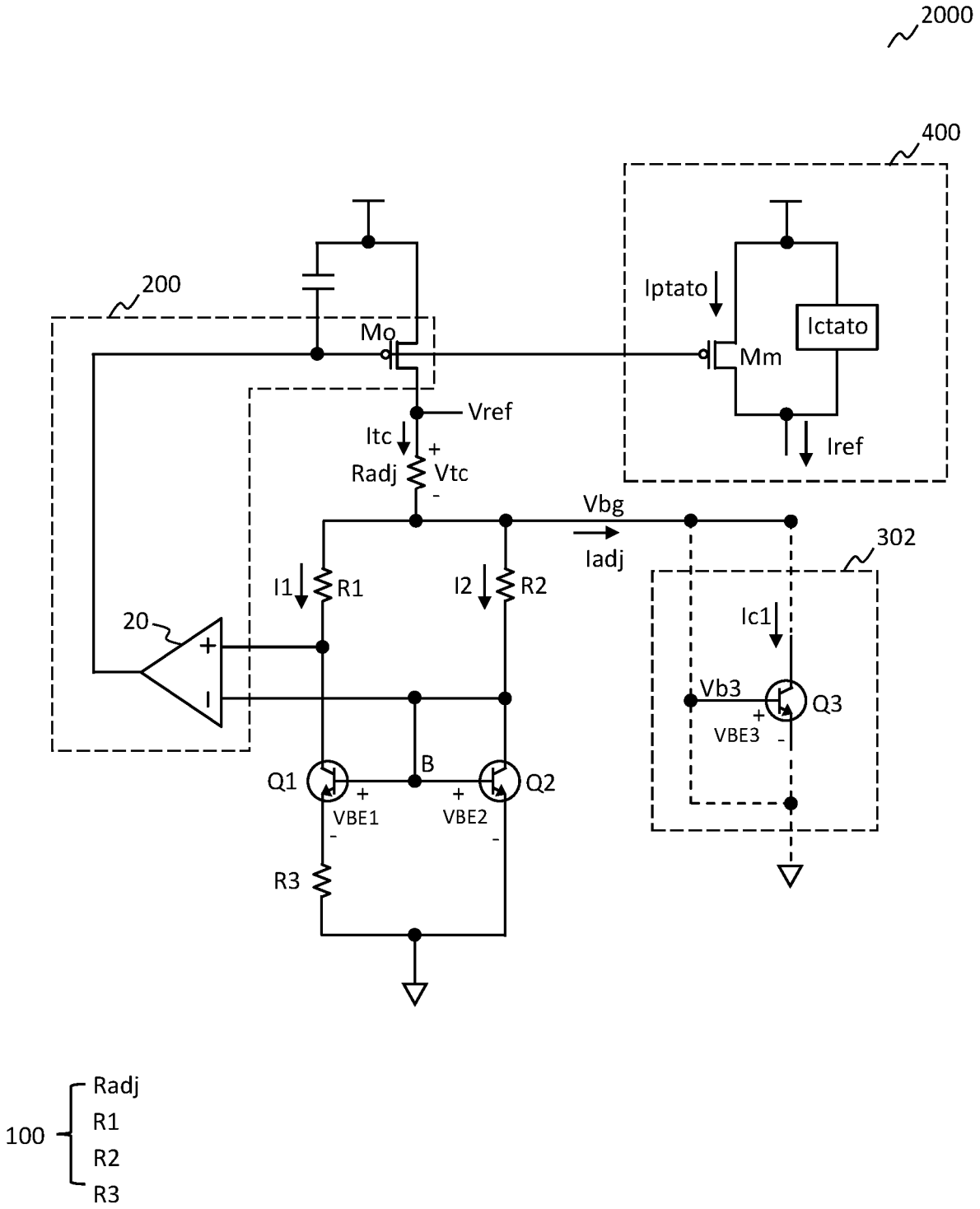
FIG. 2A shows a schematic diagram of a reference signal generator according to an embodiment of the present invention.

Please refer to FIG. 2A, which shows a schematic diagram of a reference signal generator (i.e., reference signal generator 2000) according to an embodiment of the present invention. The reference signal generator 2000 is configured to operably generate a reference signal, wherein the reference signal includes: a reference voltage Vref and/or a reference current Iref.

In one embodiment, the reference signal generator 2000 comprises: a first transistor Q1, a second transistor Q2, a feedback network 100, an amplifier circuit 200, a second order adjustment circuit 302 and a reference current generation circuit 400. In one embodiment, preferably, the first transistor Q1 and the second transistor Q2 are bipolar junction transistors (BJTs) having a same conductivity type. A base of the first transistor Q1 and a base of the second transistor Q2 are coupled to each other. Besides, a common base node B of the first transistor Q1 and the second transistor Q2 is coupled to a collector of the second transistor Q2. The first transistor Q1 and the second transistor Q2 are configured to operably generate a proportional to absolute temperature (PTAT) signal and at least one complementary to absolute temperature (CTAT) signal according to at least one bandgap of the first transistor Q1 and the second transistor Q2. The PTAT signal is positively correlated with the temperature, while, the CTAT signal substantially linearly decreases from a voltage level of the bandgap as the absolute temperature increases. In this embodiment, a difference ΔVBE between a base-emitter bias voltage VBE2 of the second transistor Q2 and a base-emitter bias voltage VBE1 of the second transistor Q1 is the PTAT signal, whereas, the base-emitter bias voltage VBE2 of the second transistor Q2 is the CTAT signal.

In this embodiment, the reference current generation circuit 400 is configured to operably superimpose a PTAT current Iptato and a CTAT current Ictato (i.e., to add these currents), so as to generate the reference current Iref. In this embodiment, the PTAT current Iptato can be obtained by a transistor Mm which mirrors the current of an output transistor Mo.

In one embodiment, as shown in FIG. 2A, the feedback network 100 includes: an adjustment resistor Radj, a resistor R1, a resistor R2 and a resistor R3. The adjustment resistor Radj is coupled to the reference voltage Vref. The resistor R1 is coupled between the adjustment resistor Radj and a collector of the first transistor Q1. The resistor R2 is coupled between the adjustment resistor Radj and a collector of the second transistor Q2. The resistor R3 is coupled between an emitter of the first transistor Q1 and a ground level.

The amplifier circuit 200 includes: an amplifier 20 and the output transistor Mo. A positive input end of the amplifier 20 is coupled to the collector of the first transistor Q1, whereas, a negative input end of the amplifier 20 is coupled to the collector of the second transistor Q2. The amplifier circuit 200 controls the first transistor Q1 to generate a first current I1 and controls the second transistor Q2 to generate a second current I2. In this embodiment, the amplifier circuit 200 is configured to operably and linearly superimpose the PTAT signal and the CTAT signal via the feedback network 100, so as to generate the reference signal. More specifically, the feedback network 100 generates a first order bandgap signal Vbg according to the first current I1 and the second current I2. In one embodiment, the first order bandgap signal Vbg is generated by linearly superimposing a voltage (PTAT) at the resistor R2 and a base-emitter bias voltage VBE2 (CTAT) of the second transistor Q2, which can be represented by the following equation:

$$Vbg=VBE2+I2*R2$$

By feedback balance mechanism, the voltage at the resistor R2 is equal to a voltage at the resistor R1. Consequently, the above-mentioned equation can be further derived as:

$$Vbg=VBE2+\Delta VBE*R1/R3°$$

In this embodiment, because the first current I1 is equal to the second current I2 (i.e., R1=R2), the above-mentioned equation can be further derived as:

$$Vbg=VBE2+\Delta VBE*R2/R3 \quad \text{(equation A)}$$

Figure 2B:
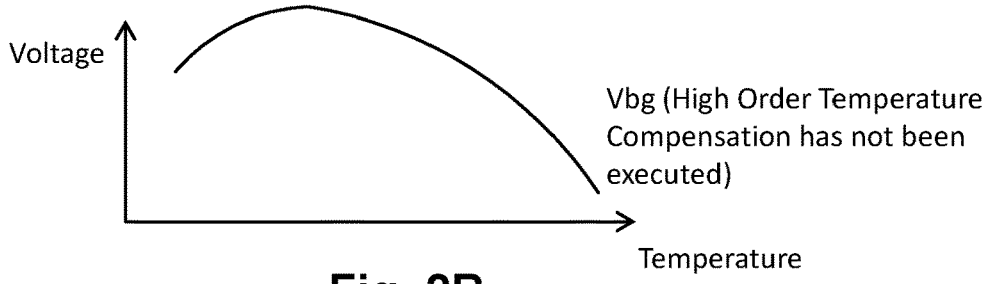
FIG. 2B shows a voltage-versus-temperature curve corresponding to a first order bandgap signal of the reference signal generator of FIG. 2A.

Please refer to FIG. 2A in conjugation with FIG. 2B. FIG. 2B shows a voltage-versus-temperature curve corresponding to a first order bandgap signal of the reference signal generator of FIG. 2A. As mentioned above, the base-emitter bias voltage VBE2 of the second transistor Q2 is the CTAT signal, whereas, the difference ΔVBE between the base-emitter bias voltage VBE2 of the second transistor Q2 and the base-emitter bias voltage VBE1 of the second transistor Q1 is the PTAT signal. Hence, by properly selecting a ratio of the resistor R2 to the resistor R3 (i.e., R2/R3), the first order bandgap signal Vbg substantially will not change as the temperature changes. However, as shown in FIG. 2B, in a realistic situation, the first order bandgap signal Vbg might still have a certain variation which changes as the temperature changes.

Figure 2C:
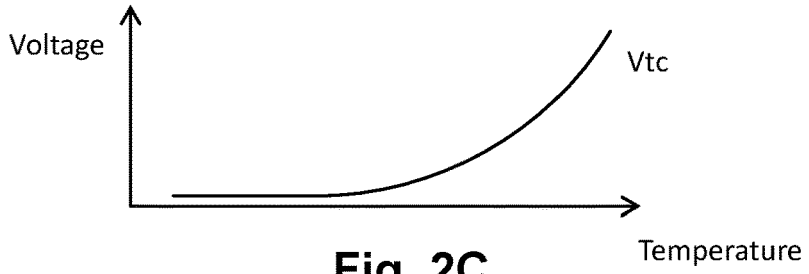
FIG. 2C shows a voltage-versus-temperature curve corresponding to a temperature compensation voltage of the reference signal generator of FIG. 2A.

Please still refer to FIG. 2A. In one embodiment, the second order adjustment circuit 302 includes a third transistor Q3. In one embodiment, the third transistor Q3 is a BJT. In one embodiment, the third transistor Q3 has a same conductivity type as the first transistor Q1 and the second transistor Q2. The third transistor Q3 is controlled by a bias voltage Vb3 to generate a collector current Ic1, which further generates an adjustment current Iadj for adjusting the reference signal (the reference signal is for example a reference voltage Vref or a reference current Iref, and the following description will use the reference voltage Vref as an illustrating example). To be more specific, in this embodiment, the adjustment resistor Radj of the feedback network 100 is configured to operably generate a temperature compensation voltage Vtc and a temperature compensation current Itc according to the first current I1, the second current I2 and the adjustment current Iadj. The base-emitter bias voltage VBE3 of the third transistor Q3 is a CTAT signal, and therefore, the collector current Ic1 of the third transistor Q3 is substantially positively correlated with a temperature under test. As a result, both the adjustment current Iadj and the temperature compensation current Itc are substantially positively correlated with the temperature under test. Please refer to FIG. 2C, which shows a voltage-versus-temperature curve corresponding to the temperature compensation voltage of the reference signal generator of FIG. 2A. As shown in FIG. 2C, the temperature compensation voltage Vtc is substantially positively correlated with a temperature under test. The reference voltage Vref is obtained by superimposing the first order bandgap signal Vbg and the temperature compensation voltage Vtc, which can be represented by the following equation:

$$Vref=Vbg+Itc*Radj \quad \text{(equation B)}$$

Figure 2D:
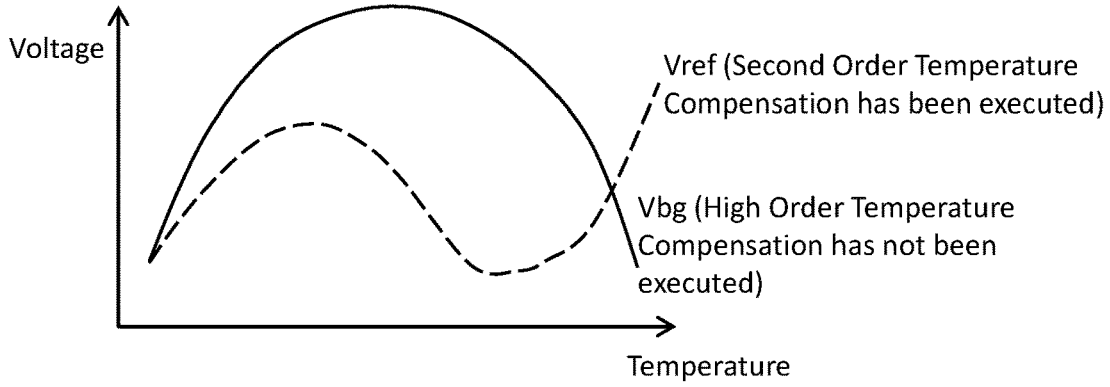
FIG. 2D shows voltage-versus-temperature curves corresponding to a reference voltage and a first order bandgap signal of the reference signal generator of FIG. 2A.

Please refer to FIG. 2B to FIG. 2D. FIG. 2D shows voltage-versus-temperature curves corresponding to the reference voltage and the first order bandgap signal of the reference signal generator of FIG. 2A. The curve indicative of the reference voltage Vref shown in FIG. 2D is obtained by superimposing the curve indicative of the first order bandgap signal Vbg shown in FIG. 2B and the curve indicative of the temperature compensation voltage Vtc shown in FIG. 2C. As shown in FIG. 2D, by temperature compensation of the temperature compensation voltage Vtc, the variation of the reference voltage Vref (as shown by a dashed curve in FIG. 2D) is smaller than the variation corresponding to the first order bandgap signal Vbg which has not been subject to high order temperature compensation. According to the equation A and the relationships among the temperature compensation current Itc, the first current I1, the second current I2 and the adjustment current Iadj, the equation B can be further derived as:

$$Vref=VBE2+(R2+2Radj)*\Delta VBE/R3+Iadj*Radj \quad \text{(equation C)}$$

As shown by the equation C, the adjustment current Iadj is configured to operably execute a second order temperature compensation on the reference voltage Vref. As shown in FIG. 2D, as compared to the first order bandgap signal Vbg which has not been subject to high order temperature compensation, after the reference voltage Vref has been subject to a second order temperature compensation by the second order adjustment circuit 302, the variation of the reference voltage Vref is smaller than the variation of the first order bandgap signal Vbg.

As shown in FIG. 2D, although the variation of the reference voltage Vref which has been subject to a second order temperature compensation as the temperature changes is smaller than the variation of the first order bandgap signal Vbg, however, within for example a higher temperature range, the reference voltage Vref which has been subject to the second order temperature compensation might still have an undesired variation of a certain extent.

Figure 3:
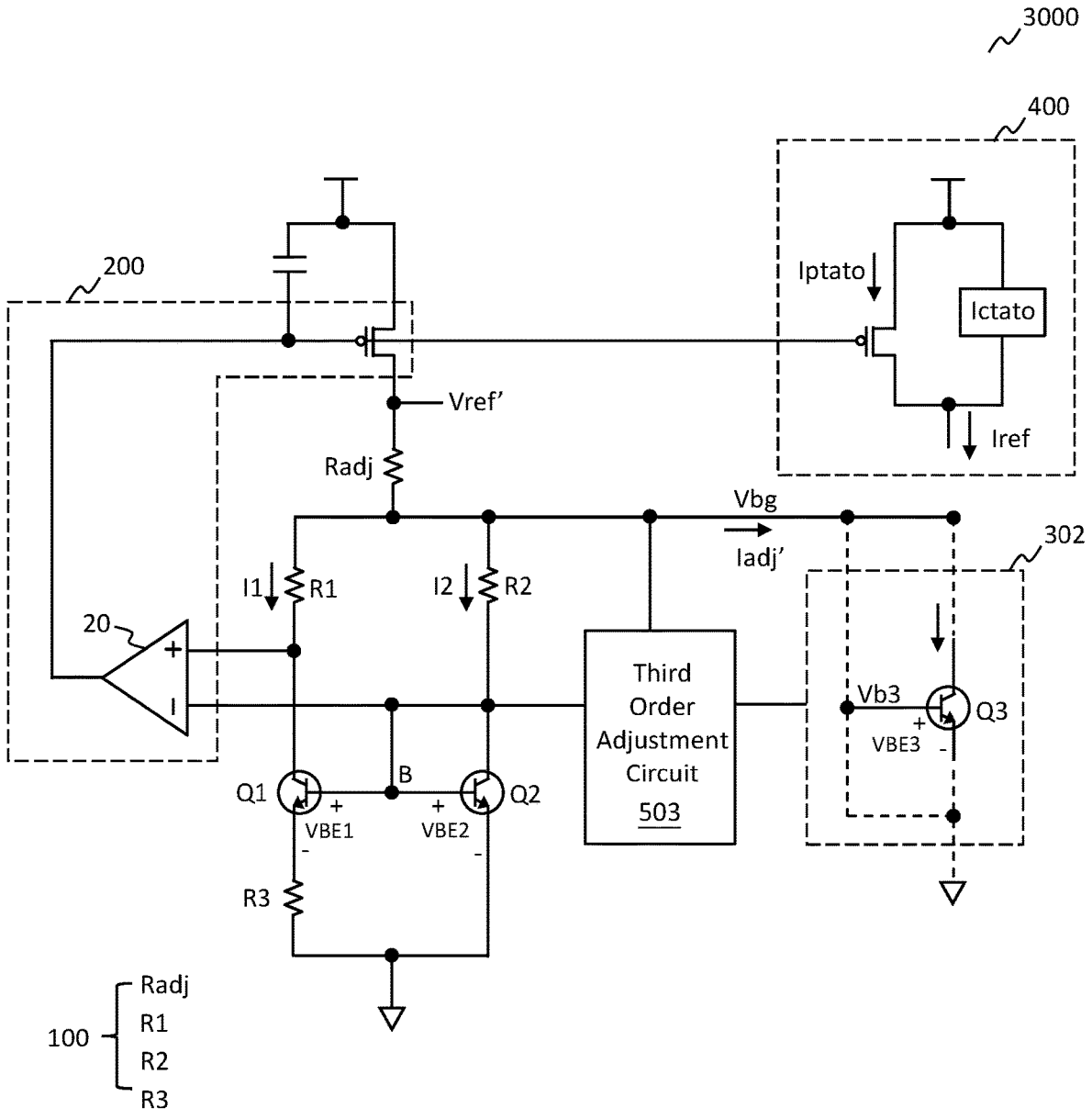
FIG. 3 shows a schematic diagram of a reference signal generator according to an embodiment of the present invention.

Please refer to FIG. 3, which shows a schematic diagram of a reference signal generator (i.e., reference signal generator 3000) according to an embodiment of the present invention. The reference signal generator 3000 further comprises a third order adjustment circuit 503, which is configured to operably adjust a bias voltage Vb3 according to a temperature under test, so as to adjust an adjustment current Iadj', and to thereby adjust a reference signal Vref', such that a variation of the reference signal Vref' is smaller than a predetermined variation range within a range of the temperature under test.

Figure 4A:
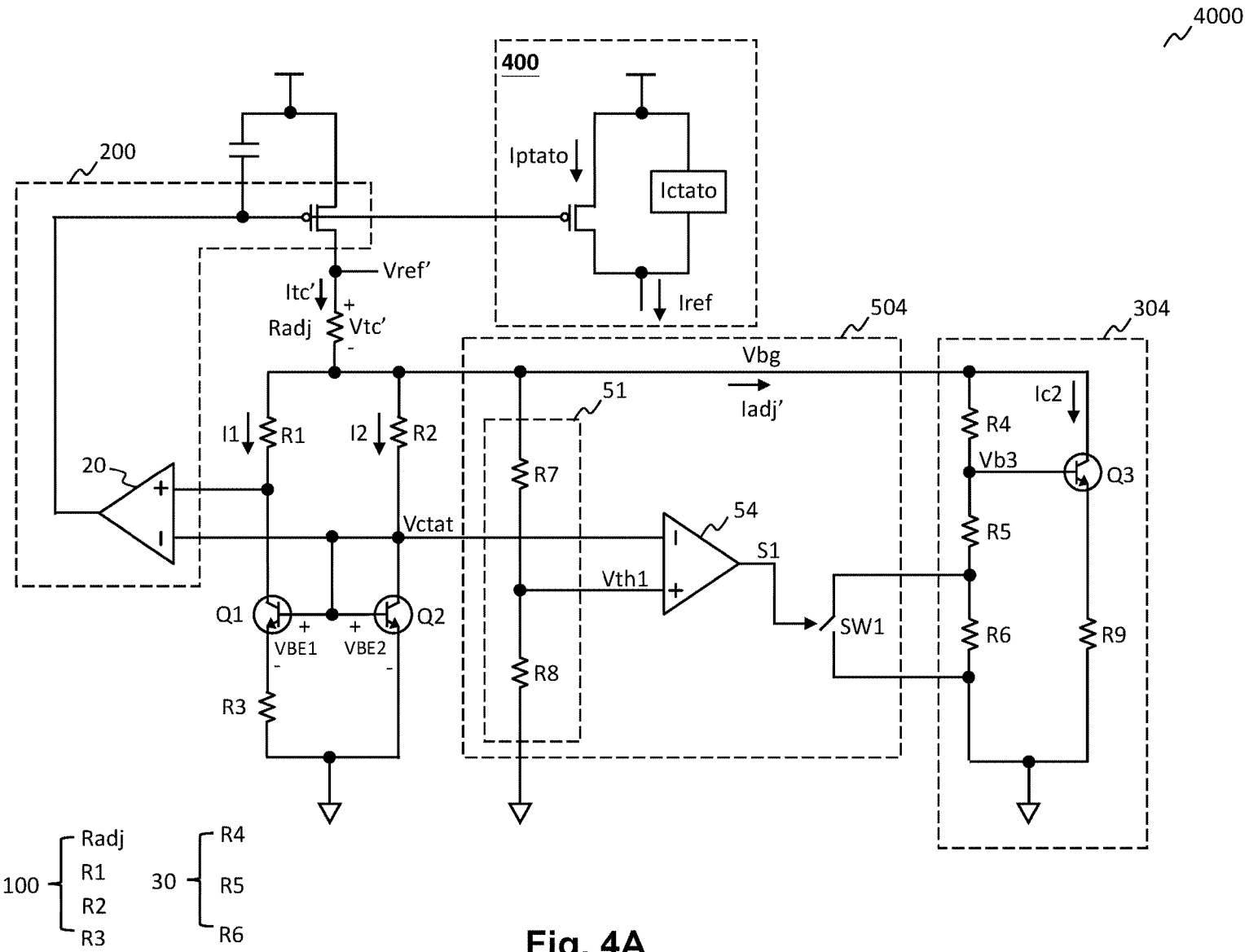
FIG. 4A shows a schematic diagram of a reference signal generator according to an embodiment of the present invention.

Please refer to FIG. 4A, which shows a schematic diagram of a reference signal generator (i.e., reference signal generator 4000) according to an embodiment of the present invention. In one specific embodiment, a second order adjustment circuit 304 further includes: a voltage-divider circuit 30 and an emitter bias voltage resistor R9. The voltage-divider circuit 30 includes: a resistor R4, a resistor R5, and a resistor R6. The resistor R4 is coupled between the first order bandgap signal Vbg and the bias voltage Vb3. The resistor R5 is coupled between the bias voltage Vb3 and the resistor R6. The resistor R6 is coupled between the resistor R5 and a ground level. In this embodiment, the voltage-divider circuit 30 is configured to operably execute voltage-division on the first order bandgap signal Vbg, so as to generate the bias voltage Vb3 to bias the base voltage of the third transistor Q3, wherein the emitter of the third transistor Q3 is coupled to the emitter bias voltage resistor R9.

As shown in FIG. 4A, in one specific embodiment, the third order adjustment circuit 504 includes: a comparator 54, an adjustment switch SW1 and a voltage-divider circuit 51. The voltage-divider circuit 51 includes: a resistor R7 and a resistor R8. The voltage-divider circuit 51 is configured to operably execute voltage-division on the first order bandgap signal Vbg, so as to generate a reference threshold Vth1. In one embodiment, the resistor R7 is coupled between the first order bandgap signal Vbg and the reference threshold Vth1. The resistor R8 is coupled between the reference threshold Vth1 and a ground level. The comparator 54 is configured to operably compare a signal Vctat related to a temperature under test (referred to as "temperature related signal Vctat" hereinafter) with the reference threshold Vth1, so as to generate a comparison signal S1. The temperature related signal Vctat is correlated with the temperature under test. In this embodiment, the temperature related signal Vctat is a CTAT signal. The adjustment switch SW1 is switched according to the comparison signal S1, so as to adjust the bias voltage Vb3.

Please still refer to FIG. 4A. In one embodiment, the third order adjustment circuit 504 adjusts a voltage-division ratio of the voltage-divider circuit 30 according to the temperature under test, so as to execute a third order temperature compensation on the reference voltage Vref'. To elaborate in more detail, in this embodiment, the adjustment switch SW1 is connected in parallel to the resistor R6. The temperature related signal Vctat decreases as the temperature increases. When the temperature related signal Vctat is smaller than the reference threshold Vth1, the comparator 54 controls the adjustment switch SW1 to be ON according to the comparison signal S1, whereby the bias voltage Vb3 decreases, thus causing a collector current Ic2 of the third transistor Q3 to decrease, so that the adjustment current Iadj' decreases. In this embodiment, the adjustment resistor Radj is configured to operably generate a temperature compensation voltage Vtc' and a temperature compensation current Itc' according to the first current I1, the second current I2 and the adjustment current Iadj'. The reference voltage Vref' is obtained by superimposing the first order bandgap signal Vbg and the temperature compensation voltage Vtc', which can be represented by the following equation:

$$Vref'=Vbg+Itc'*Radj \quad \text{(equation D)}$$

According to the equation A and the relationships among the temperature compensation current Itc', the first current I1, the second current I2 and the adjustment current Iadj', the equation D can be further derived as:

$$Vref'=VBE2+(R2+2Radj)*\Delta VBE/R3+Iadj'*Radj \quad \text{(equation E)}$$

Figure 4B:
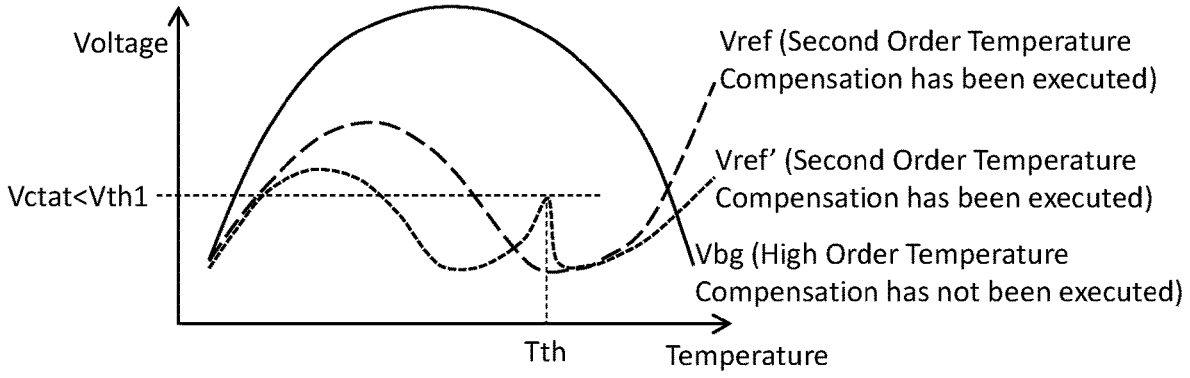
FIG. 4B shows voltage-versus-temperature curves corresponding to a reference voltage and a first order bandgap signal of the reference signal generator of FIG. 2A and the reference signal generator of FIG. 4A.

Please refer to FIG. 4B, equation C and equation E. FIG. 4B shows voltage-versus-temperature curves corresponding to the reference voltage and the first order bandgap signal of the reference signal generator of FIG. 2A and the reference signal generator of FIG. 4A. As compared to the adjustment current Iadj of the equation C, the adjustment current Iadj' of the equation E has been subject to a third order temperature compensation by the third order adjustment circuit 504. When the temperature related signal Vctat is smaller than the reference threshold Vth1 (i.e., the temperature under test is higher than a temperature threshold Tth), the reference voltage Vref' is subject to a third order temperature compensation, so that the variation of the reference voltage Vref' which has been subject to the third order temperature compensation is not only smaller than the variation of the first order bandgap signal Vbg, but also smaller than the variation of the reference voltage Vref which has been subject to the second order temperature compensation, as the temperature changes. As shown in FIG. 4B, the first order bandgap signal Vbg which has not been subject to any temperature compensation is indicated by a solid line, whereas, the reference voltage Vref which has been subject to the second order temperature compensation is indicated by a long dashed line, whereas, the reference voltage Vref' which has been subject to the third order temperature compensation is indicated by a short dashed line. As illustrated by FIG. 4B, as compared to the first order bandgap signal Vbg which has not been subject to high order temperature compensation, the reference signal generator 4000 of the present invention which executes a third order temperature compensation in addition to a second order temperature compensation, can even more decrease the variation of the reference voltage Vref' to thereby further enhance the precision of the system.

Figure 4C:
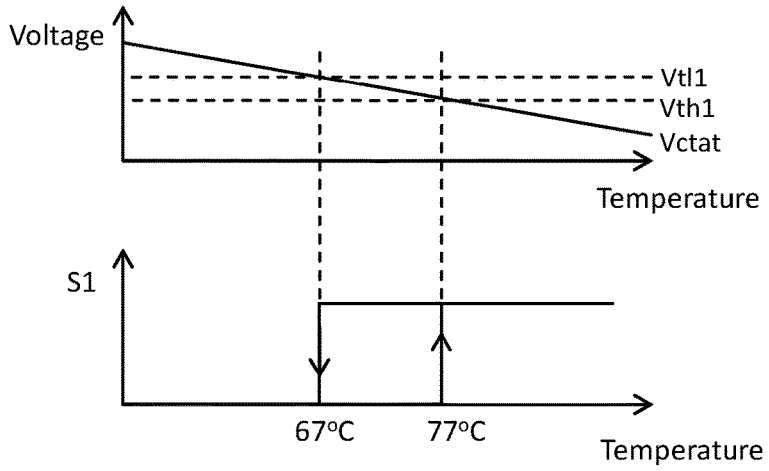
FIG. 4C shows a hysteresis relationship between the reference threshold and the temperature related signal of FIG. 4A.

Please refer to FIG. 4A in conjugation with FIG. 4C. FIG. 4C shows a hysteresis relationship between the reference threshold and the temperature related signal of FIG. 4A. In one embodiment, preferably, a hysteresis relationship exists between the reference threshold Vth1 and the temperature related signal Vctat. To elaborate in more detail, when the temperature related signal Vctat is smaller than the reference threshold Vth1 (i.e., the temperature under test is higher than a temperature threshold Tth such as 77° C.), the comparison signal S1 switches from a first state to a second state. Under such circumstance, the reference threshold is switched from the reference threshold Vth1 to the hysteresis threshold Vtl1, wherein the hysteresis threshold Vtl1 is greater than the reference threshold Vth1, so that the temperature related signal Vctat is compared with two thresholds with a hysteresis relationship in between, or, in another perspective, so that the temperature related signal Vctat has a hysteresis relationship with the reference threshold Vth1. In the given example, there is a temperature hysteresis of for example 10° C. (as shown by 67° C. in FIG. 4C) between the two thresholds. In one embodiment, the comparator 54 shown in FIG. 4A can adopt a hysteresis comparator, so that the above-mentioned hysteresis relationship can be carried out.

Figure 5:
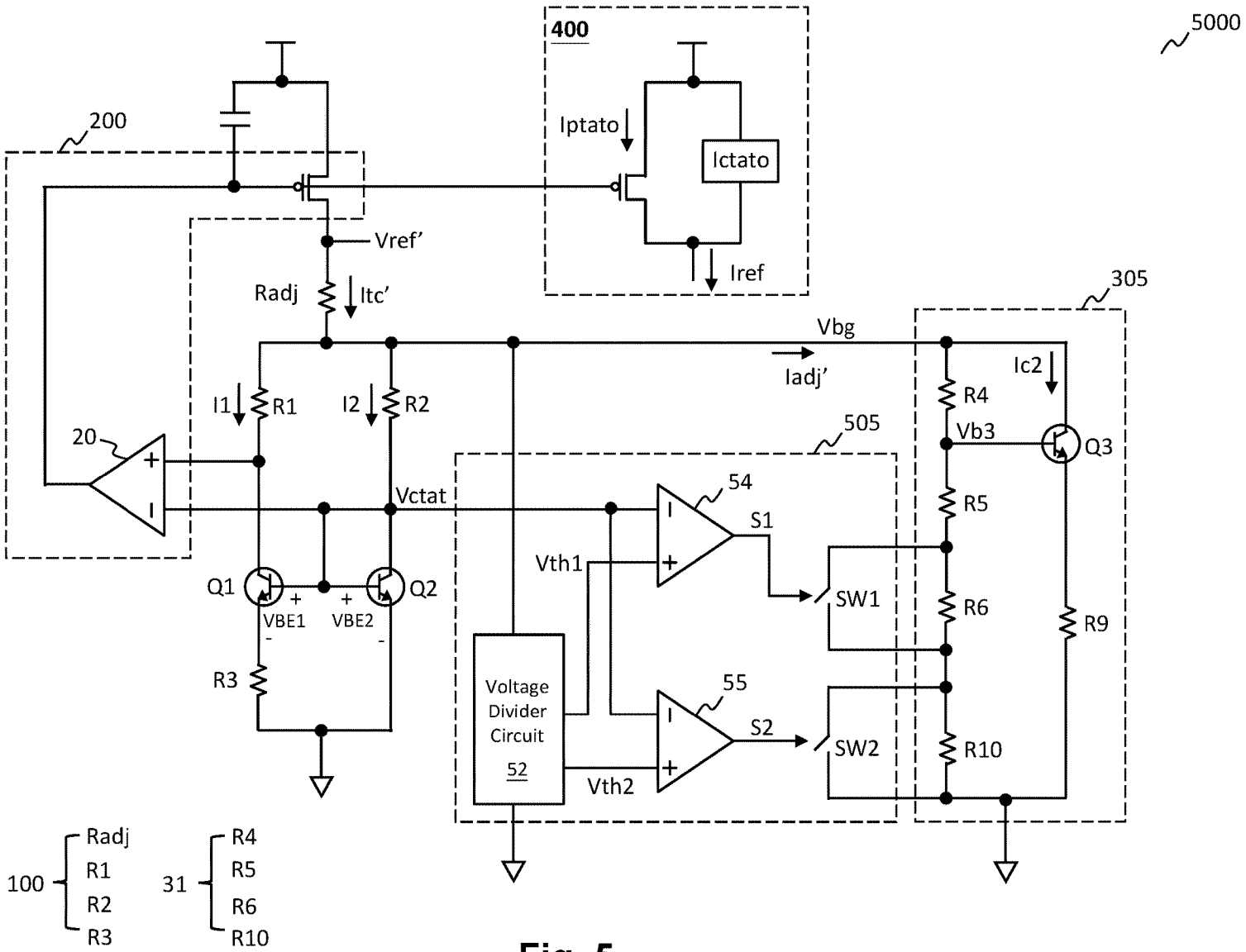
FIG. 5 shows a schematic diagram of a reference signal generator according to an embodiment of the present invention.

Please refer to FIG. 5, which shows a schematic diagram of a reference signal generator (i.e., reference signal generator 5000) according to an embodiment of the present invention. In one embodiment, as shown in FIG. 5, a voltage-divider circuit 31 of the second order adjustment circuit 305 further includes a resistor R10, wherein the resistor R10 is coupled between the resistor R6 and a ground level. In addition, the third order adjustment circuit 505 further includes a comparator 55 and an adjustment switch SW2, wherein the adjustment switch SW2 is connected in parallel to the resistor R10. In this embodiment, the voltage-divider circuit 52 is configured to operably execute voltage-division on the first order bandgap signal Vbg, so as to generate the reference threshold Vth1 and a reference threshold Vth2. The comparator 55 is configured to operably compare the temperature related signal Vctat with the reference threshold Vth2, so as to generate a comparison signal S2. The adjustment switch SW2 is switched according to the comparison signal S2, so as to adjust the bias voltage Vb3, thereby adjusting the collector current Ic2 of the third transistor Q3, so as to adjust an effect of the third order temperature compensation on reference voltage Vref' by the adjustment current Iadj'. In one embodiment, the third order adjustment circuit 505 can execute the third order temperature compensation by plural different reference thresholds (e.g., Vth1 and Vth2) at different temperature ranges, so that the third order temperature compensation can be more accurate, to thereby further reduce the variation of the reference voltage Vref' as the temperature changes. Please note that the reference current Iref shown in FIG. 4A and FIG. 5 also can be subject to the aforementioned third order temperature compensation, which is not redundantly repeated here.

In one perspective, the reference signal generator of the present invention can execute a third order temperature compensation on a reference signal via a third order adjustment circuit, which can greatly reduce the variation of the reference signal, whereby the precision of the overall system is greatly enhanced. Additionally, the third order temperature compensation of the present invention can be implemented as a circuit capable of executing multi-level adjustments, so as to control the third order temperature compensation on the reference signal by multiple levels, whereby the generated reference signal is very much close to the ideal state.

The present invention has been described in considerable detail with reference to certain preferred embodiments thereof. It should be understood that the description is for illustrative purpose, not for limiting the broadest scope of the present invention. An embodiment or a claim of the present invention does not need to achieve all the objectives or advantages of the present invention. The title and abstract are provided for assisting searches but not for limiting the scope of the present invention. Those skilled in this art can readily conceive variations and modifications within the spirit of the present invention. For example, to perform an action "according to" a certain signal as described in the context of the present invention is not limited to performing an action strictly according to the signal itself, but can be performing an action according to a converted form or a scaled-up or down form of the signal, i.e., the signal can be processed by a voltage-to-current conversion, a current-to-voltage conversion, and/or a ratio conversion, etc. before an action is performed. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment. In view of the foregoing, the spirit of the present invention should cover all such and other modifications and variations, which should be interpreted to fall within the scope of the following claims and their equivalents.

What is claimed is:

1. A reference signal generator, which is configured to operably generate a reference signal, wherein the reference signal includes: a reference voltage and/or a reference current; the reference signal generator comprising:

a first transistor and a second transistor coupled to each other, wherein the first transistor and the second transistor are configured to operably generate a proportional to absolute temperature (PTAT) signal and at least one complementary to absolute temperature (CTAT) signal according to at least one bandgap related to the first transistor and the second transistor, wherein the CTAT signal substantially linearly decreases from a voltage level of the bandgap as an absolute temperature increases;

a feedback network coupled to the first transistor and the second transistor;

an amplifier circuit coupled to the first transistor and the second transistor, wherein the amplifier circuit is configured to operably and linearly superimpose the PTAT signal and the CTAT signal via the feedback network, so as to generate the reference signal;

a second order adjustment circuit including a third transistor, wherein the third transistor is controlled by a bias voltage, so as to generate an adjustment current for adjusting the reference signal, wherein the adjustment current is positively correlated with a temperature under test; and a third order adjustment circuit, which is configured to operably adjust the bias voltage according to the temperature under test, thus adjusting the adjustment current, and to thereby adjust the reference signal, such that a variation of the reference signal is smaller than a predetermined variation range within a range of the temperature under test;

wherein the third order adjustment circuit includes: a comparator and an adjustment switch, wherein the comparator is configured to operably compare a signal related to the temperature under test (temperature related signal) with a reference threshold, so as to generate a comparison result, wherein the temperature related signal is correlated with the temperature under test, wherein the adjustment switch is switched according to the comparison result, so as to adjust the bias voltage.

2. The reference signal generator of claim 1, wherein the first transistor and the second transistor are bipolar junction transistors (BJTs) having a same conductivity type.

3. The reference signal generator of claim 2, wherein the third transistor is a BJT, and wherein the third transistor has a same conductivity type as the first transistor and the second transistor.

4. The reference signal generator of claim 3, wherein a base voltage of the third transistor is controlled by the bias voltage, wherein the adjustment current is generated according to a collector current of the third transistor.

5. The reference signal generator of claim 1, wherein a hysteresis relationship exists between the reference threshold and the temperature related signal.

6. The reference signal generator of claim 1, wherein the temperature related signal is a CTAT signal.

7. The reference signal generator of claim 3, wherein the amplifier circuit controls the first transistor to generate a first current and controls the second transistor to generate a second current, wherein the feedback network generates a first order bandgap signal according to the first current and the second current;

wherein the feedback network includes: an adjustment resistor, which is configured to operably generate a temperature compensation voltage at the adjustment resistor according to the first current, the second current and the adjustment current; and wherein the reference signal is obtained by superimposing the first order bandgap signal and the temperature compensation voltage.

8. The reference signal generator of claim 6, wherein the second order adjustment circuit further includes: a voltage-divider circuit, which is configured to operably execute voltage-division on the first order bandgap signal to generate the bias voltage, for biasing the base voltage of the third transistor, wherein the third order adjustment circuit adjusts a voltage-division ratio of the voltage-divider circuit according to the temperature under test.

* * * * *